US008172502B2

(12) United States Patent
Lincoln et al.

(10) Patent No.: US 8,172,502 B2
(45) Date of Patent: May 8, 2012

(54) BYPASS PASSAGE FOR FLUID PUMP

(75) Inventors: Thomas Lincoln, Harrisburg, PA (US); Dennis Kreft, Davisburg, MI (US); Timothy Wade, Rochester Hills, MI (US)

(73) Assignee: Cooper-Standard Automotive Inc., Novi, MI (US)

( * ) Notice: Subject to any disclaimer, the term of this patent is extended or adjusted under 35 U.S.C. 154(b) by 956 days.

(21) Appl. No.: 11/996,374

(22) PCT Filed: Aug. 8, 2006

(86) PCT No.: PCT/US2006/030874

§ 371 (c)(1),
(2), (4) Date: Jul. 16, 2008

(87) PCT Pub. No.: WO2007/019496

PCT Pub. Date: Feb. 15, 2007

(65) Prior Publication Data

US 2008/0298954 A1 Dec. 4, 2008

(51) Int. Cl.
*F04D 7/02* (2006.01)
*F04D 1/36* (2006.01)

(52) U.S. Cl. ..... 415/90

(58) Field of Classification Search ..... 415/90, 415/213, 206, 227; 417/383, 394
See application file for complete search history.

(56) References Cited

U.S. PATENT DOCUMENTS

| | | | | |
|---|---|---|---|---|
| 4,768,920 | A * | 9/1988 | Gurth | 415/90 |
| 5,331,986 | A * | 7/1994 | Lim et al. | 134/88 |
| 6,746,219 | B1 * | 6/2004 | Chen | 417/424.1 |

FOREIGN PATENT DOCUMENTS

| | | | |
|---|---|---|---|
| DE | 19709484 | A1 | 9/1998 |
| DE | 19823603 | A1 | 12/1999 |
| EP | 0953773 | A1 | 11/1999 |
| FR | 788955 | A | 10/1935 |
| JP | 02055824 | A | 2/1990 |
| JP | 4209992 | | 7/1992 |
| JP | 9112380 | | 4/1997 |
| JP | 02055824 | * | 2/1999 |

OTHER PUBLICATIONS

Search Report PCT/US2006/030874.
International Preliminary Report on Patentability dated Feb. 12, 2008.
English translation of Notice of Reasons for Rejection, Japanese Patent Application No. JP2008-526133, received Nov. 8, 2011.

* cited by examiner

*Primary Examiner* — Calvin Lee
(74) *Attorney, Agent, or Firm* — Carlson Gaskey & Olds, P.C.

(57) ABSTRACT

A fluid pump (10) includes a pumping chamber (14), an inlet (16) and an outlet (18) fluidly connected with the pumping chamber, and a passage (24) fluidly connected between the inlet and the outlet. Fluid flowing through the passage bypasses the pumping chamber. In one example, the fluid pump (10) pumps coolant within a vehicle cooling system between a heater core (23*b*) and a vehicle engine (23*a*).

11 Claims, 2 Drawing Sheets

BYPASS PASSAGE FOR FLUID PUMP

BACKGROUND OF THE INVENTION

This invention relates to water pumps, and, more particularly, to a water pump having a bypass channel that leads from a pump inlet to a pump outlet and allows fluid entering the water pump to bypass a main impeller chamber.

Conventional water pumps are widely known and used, for example, in vehicles to circulate coolant through an engine cooling system. Typical pumps include a central chamber having an actuator-driven impeller in fluid communication with a pump inlet and a pump outlet. The impeller pushes fluid received through the pump inlet out through the pump outlet.

During operation of the pump, there is often a pressure differential between the pump inlet and the pump outlet caused by the presence, rotation and operation of the impeller. In the off state, reduction in flow equals greater pressure differential, which results in lowered operational efficiency. In the on state, the lack of gain in flow equals greater pressure differential resulting in a lowered operational efficiency. If the pressure differential becomes too large, the operation of the engine cooling system, for example, and various components within the engine cooling system may not function as desired.

Conventional pumps can be designed with a spacing or gap between the impeller and an inner surface of the central chamber to alleviate some of the pressure differential. Undesirably, the spacing causes turbulence in fluid flow within the central chamber, which interferes with operation of the impeller and reduces pumping efficiency.

Accordingly, a fluid pump that minimizes the pressure differential without significantly negatively effecting impeller operation is needed.

SUMMARY OF THE INVENTION

An example fluid pump includes a pumping chamber, an inlet and an outlet fluidly connected with the pumping chamber, and a passage fluidly connected between the inlet and the outlet. Fluid flowing through the passage bypasses the pumping chamber. In one example, the fluid pump is pumps coolant within a vehicle cooling system between a heater core and a vehicle engine. a pumping chamber;

In another aspect, the fluid pump includes a pumping chamber and an actuator-driven impeller at least partially within the pumping chamber. An inlet and an outlet are fluidly connected with the pumping chamber, and a tapered passage fluidly connects the inlet and the outlet. Fluid flowing through the passage bypasses the pumping chamber.

An example method of controlling a fluid pump having an inlet and an outlet fluidly connected with a pumping chamber includes the steps of producing a fluid pressure difference between the inlet and the outlet. The fluid is then bled through the passage connected between the inlet and the outlet to bypass fluid flow through the pumping chamber and thereby reduce the fluid pressure difference.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
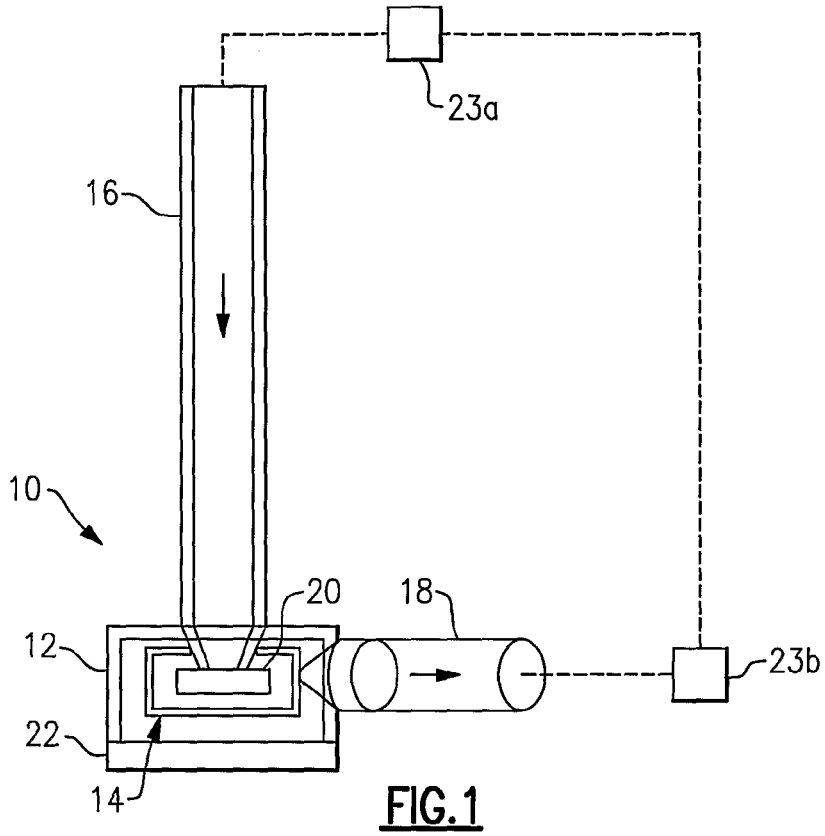
FIG. 1 shows a schematic view of an example pump system.

FIG. 1 illustrates a schematic view of selected portions of a pump 10 that is used, for example, in vehicles to circulate fluid through a cooling system. In the illustrated example, the pump 10 includes a housing 12 that defines a central chamber 14. The housing 12 has an inlet 16 and an outlet 18 fluidly connected to the central chamber 14. An impeller 20 is received in the central chamber 14 and is driven by an actuator 22, such as an electric motor, brush-style magnetic motor, brushless DC motor, or other known actuator. In this example, the pump 10 receives a coolant from a vehicle engine 23*a* through the inlet 16 into the central chamber 14. The impeller 20 propels the coolant through the outlet 18 to a vehicle heater core 23*b*.

Figure 2A:
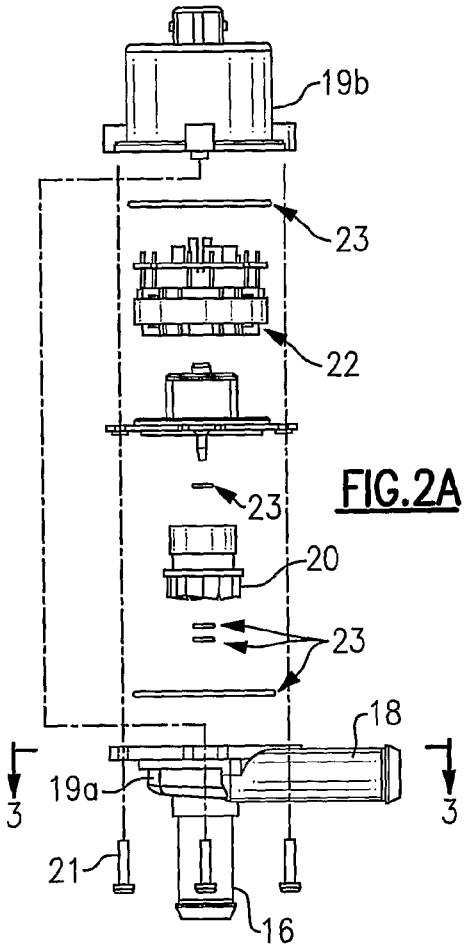
FIG. 2A shows an exploded view showing an example pump.
Figure 2B:
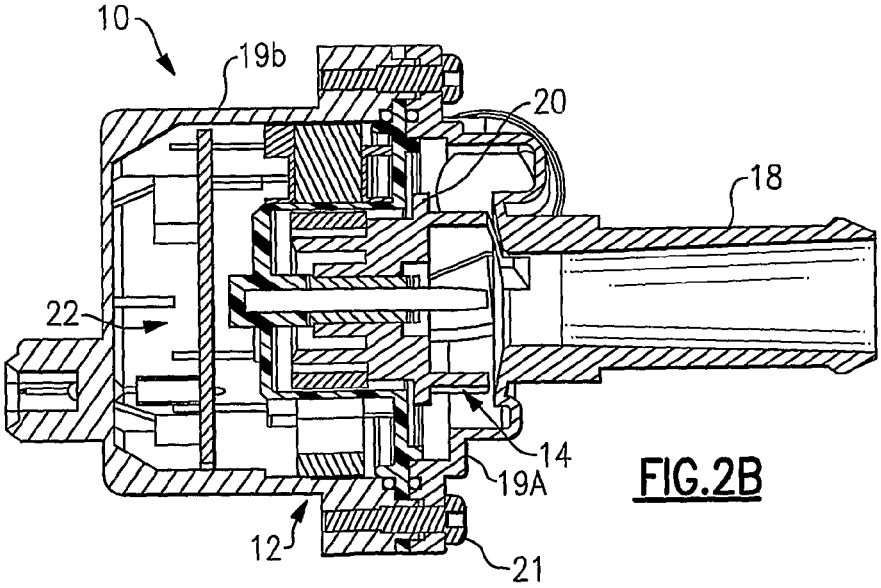
FIG. 2B shows an assembled view of the example pump.

FIG. 2A shows an exploded view of one example pump 10, and FIG. 2B shows a cross-section of the example pump 10 assembled. In this example, the housing 12 includes a first section 19*a* that is secured to a second section 19*b* with fasteners 21. The impeller 20, the actuator 22, and several other components 23 (e.g., o-rings, spacers, friction rings) are encased between the housing sections 19*a* and 19*b*.

Figure 3:
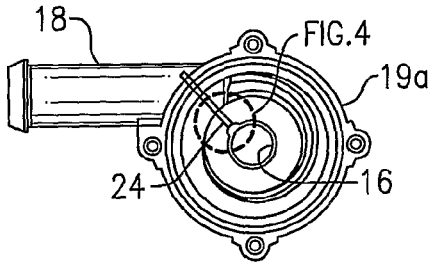
FIG. 3 shows a bypass channel within a section of the pump housing of the pump.
Figure 4:
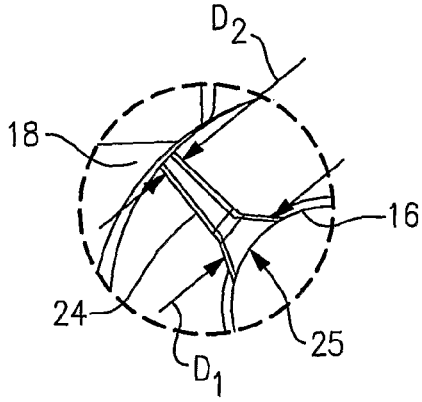
FIG. 4 shows more detailed view of the bypass channel of FIG. 3.

Referring to FIGS. 3 and 4, the first section 19*a* of the pump housing 12 includes a bypass channel 24 that fluidly connects the inlet 16 and the outlet 18. In this example, the bypass channel 24 includes a first opening 25 fluidly connected with the inlet 16 and a second opening 26 fluidly connected with the outlet 18. The first opening includes a first dimension $D_1$ and the second opening includes a second dimension $D_2$ that is smaller than the first opening 25. In other words, the bypass channel 24 tapers from the outlet 18 to the inlet 16.

During operation of the pump 10, a portion of the incoming fluid in the inlet 16 flows through the bypass channel 24 into the outlet 18 without flowing into and through the central chamber 14. Fluid that does not flow into the bypass channel 24 flows into the central chamber 14 and is propelled out of the outlet 18 by the impeller 20 as described above. It is to be understood that although the bypass channel 24 is shown as having a certain size, shape and location, that alternate sizes, shapes, and locations can also be used.

In the illustrated example, the bypass channel 24 provides the benefit of stabilizing the fluid flow through the pump 10 and reduces a pressure differential between the inlet 16 and the outlet 18. In one example, when the pump 10 is inactive, the bypass channel 24 allows fluid to bleed through the bypass channel 24 from the inlet 16 to the outlet 18 or from the outlet 18 to the inlet 16 without resistive rotation of the impeller 20. This feature reduces the pressure differential between inlet 16 and the outlet 18 when the pump 10 is inactive because the fluid can freely flow between the inlet 16 and the outlet 18 without interference from the impeller 20.

In another example, when the pump is active, the bypass channel 24 allows a portion of the fluid to bleed through the bypass channel 24 without entering the central chamber 14.

This allows the fluid to avoid a pressure build-up in the central chamber 14 due to the impeller 20 and tends to equalize the pressure between inlet 16 and outlet 18.

The size, shape, and location of the bypass channel 24 can be tailored to meet the needs of a particular design or application. Is can be appreciated from the illustrated examples, the bypass channel 24 is generally smaller in cross-sectional area than the inlet 16 and the outlet 18. In another example, the bypass channel 24 is made larger than illustrated in FIGS. 3 and 4 to allow more fluid to bleed there through. This further reduces the pressure differential between inlet 16 and the outlet 18, however, making the bypass channel 24 too large may reduce the pumping efficiency of the pump 10. In another example, the bypass channel 24 is made smaller than illustrated in FIGS. 3 and 4. A smaller bypass channel 24 provides less of a pressure equalizing effect between the inlet 16 and the outlet 18. If the size of the bypass channel 24 is made to be too small, there may be insufficient pressure equalizing effect.

In the illustrated examples, the housing 12 is molded from a plastic material. In one example, the plastic material is a plastic composite of polyamide and 35% glass fibers. This provides a combination of relatively high strength and low weight. Alternatively, the housing 12 may be cast from a metal material or formed in other known manufacturing methods.

Figure 5:
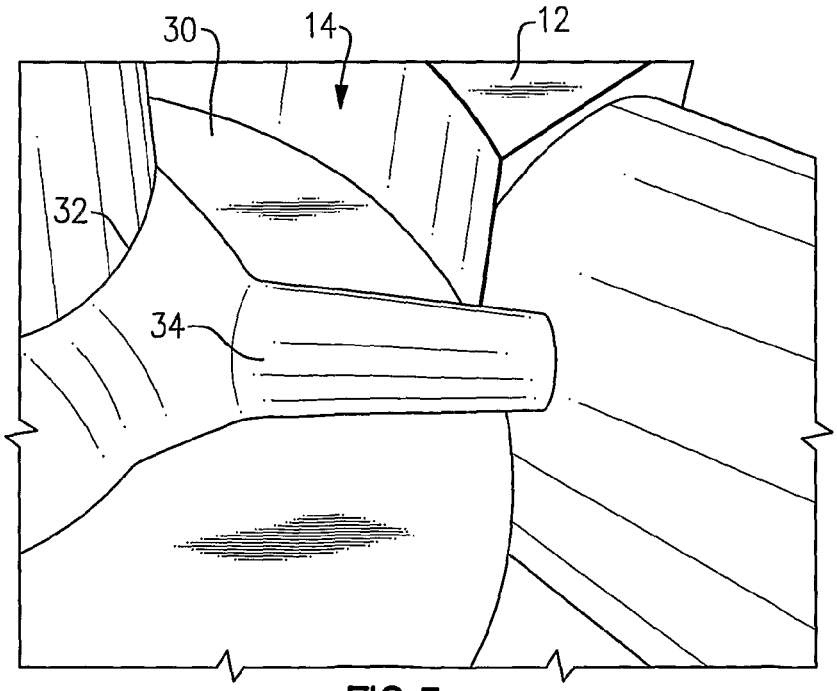
FIG. 5 shows a portion of a central chamber within the pump.

FIG. 5 is a perspective view showing a selected portion within the central chamber 14. In this example, the housing 12 includes surfaces 30 that define the central chamber 14. In this example, the bypass channel 24 extends underneath the surfaces 30 between the inlet 16 and the outlet 18. A portion 32 (circled) of the surface 30 defines part of the central chamber 14 and a part of the bypass channel 24 such that the bypass channel 24 and the central chamber 14 have a common wall between them. In the illustration, the bypass channel 24 forms a small bulge 34 within the central chamber 14. In this example, the bulge 34 has a minimal effect on the operation of the impeller 20 and on the flow of fluid through the central chamber 14. In other examples, the bypass channel 24 is located farther from the central chamber 14 such that there is no bulge 34.

Although a preferred embodiment of this invention has been disclosed, a worker of ordinary skill in this art would recognize that certain modifications would come within the scope of this invention. For that reason, the following claims should be studied to determine the true scope and content of this invention.

The invention claimed is:

1. A fluid pump comprising:

a pumping chamber;

an inlet fluidly connected with the pumping chamber;

an outlet fluidly connected with the pumping chamber; and a passage fluidly connected between the inlet and the outlet such that fluid flowing through the passage bypasses the pumping chamber, wherein fluid flowing through the bypass passage enters the bypass passage without entering the pumping chamber, and wherein fluid flowing through the bypass passage exits the passage at said outlet without entering the pumping chamber.

2. The fluid pump as recited in claim 1, further comprising an actuator-driven impeller at least partially within the pumping chamber.

3. The fluid pump as recited in claim 1, further comprising a pump housing section made of a single, unitary piece, wherein the pump housing section includes the inlet, the outlet, and the passage formed therein.

4. The fluid pump as recited in claim 3, wherein the pump housing comprises a composite of polyamide and glass fibers.

5. The fluid pump as recited in claim 1, wherein the inlet, the outlet, and the passage each include a respective nominal diameter, and the nominal diameter of the passage is less than the nominal diameters of the inlet and the outlet.

6. The fluid pump as recited in claim 1, wherein the passage is tapered.

7. The fluid pump as recited in claim 1, wherein the passage includes a first opening fluidly connected with the inlet and a second opening fluidly connected with the outlet, wherein the first opening has an associated first area and the second opening has an associated second area that is smaller than the first area.

8. The fluid pump as recited in claim 1, further comprising a heater core fluidly connected with the outlet.

9. The fluid pump as recited in claim 8, further comprising a vehicle combustion engine fluidly connected with the inlet and the heater core.

10. A fluid pump comprising:

a pumping chamber;

an actuator-driven impeller at least partially within the pumping chamber;

an inlet fluidly connected with the pumping chamber;

an outlet fluidly connected with the pumping chamber; and a tapered passage fluidly connected between the inlet and the outlet such that fluid flowing through the passage bypasses the pumping chamber, wherein fluid flowing through the bypass passage enters the bypass passage without entering the pumping chamber, and wherein fluid flowing through the bypass passage exits the passage at said outlet without entering the pumping chamber.

11. The fluid pump as recited in claim 10, wherein the tapered passage narrows in cross-sectional area from the inlet to the outlet.

* * * * *